United States Patent [19]

Kroh et al.

[11] 4,370,870

[45] Feb. 1, 1983

[54] CROCHETING AID

[76] Inventors: Norma J. Kroh, c/o George Spector, 3615 Woolworth Bldg., 233 Broadway; George Spector, 3615 Woolworth Bldg., 233 Broadway, both of New York, N.Y. 10007

[21] Appl. No.: 207,754

[22] Filed: Nov. 17, 1980

[51] Int. Cl.[3] ..... D04B 35/00

[52] U.S. Cl. ..... 66/1 A

[58] Field of Search ..... 66/1 R, 1 S, 1 A, 4, 66/116, 125 R

[56] References Cited

U.S. PATENT DOCUMENTS

| | | | |
|---|---|---|---|
| 1,473,953 | 11/1923 | Dart | 66/2 |
| 2,434,609 | 1/1948 | Coffey | 66/125 UX |
| 2,524,157 | 10/1950 | Beirer | 66/125 R |
| 4,037,433 | 7/1977 | Weber | 66/1 A |

FOREIGN PATENT DOCUMENTS

| | | | |
|---|---|---|---|
| 1093658 | 11/1954 | France | 60/1 A |

*Primary Examiner*—Ronald Feldbaum

[57] ABSTRACT

A device designed to aid arthritic persons in crocheting, which is fastened to the disabled hand so that it may be used to cooperate with the other good hand in crocheting yarn to fabric.

3 Claims, 4 Drawing Figures

22b
22c
22d
13
12
22a
18a
19
20
22
18
18b
17
16
15
14
11
10

15
17
18
21
18b
18a
13
3
20
19
18b
3
13
17
21a
18b
19
20
18b
18a
13
15
18
22e
22
13

22b
22c
22a
22d
27
26
28
23
24

CROCHETING AID

BACKGROUND OF THE INVENTION

There are many persons who have experienced how a physical disability inhibiting a skilled activity in which one had attained a degree of familiarity and perfection (such as playing an instrument, or crocheting colorful sweaters) can be a big frustration. Often it is only one hand that refuses to follow suit whereas the other hand is still healthy. In such cases it would be desireable to assist the disabled hand by auxiliary means to play the intended role.

MAIN OBJECT OF THE INVENTION

Accordingly, it is the main object of the invention to enable a person to take up crocheting in spite of having one of the hands incapacitated.

A further object is to render such means attachable to the disabled hand in a simple manner.

Still further an object of the invention is to hold the crocheting yarn close to the forefinger of the disabled. Another object is also to provide means for imitating the resilient holding of a yarn to feed the yarn to the crocheting point under a slight tension which is needed for the crocheting process.

SUMMARY OF THE INVENTION

Figures 1, 2, 3, 4:
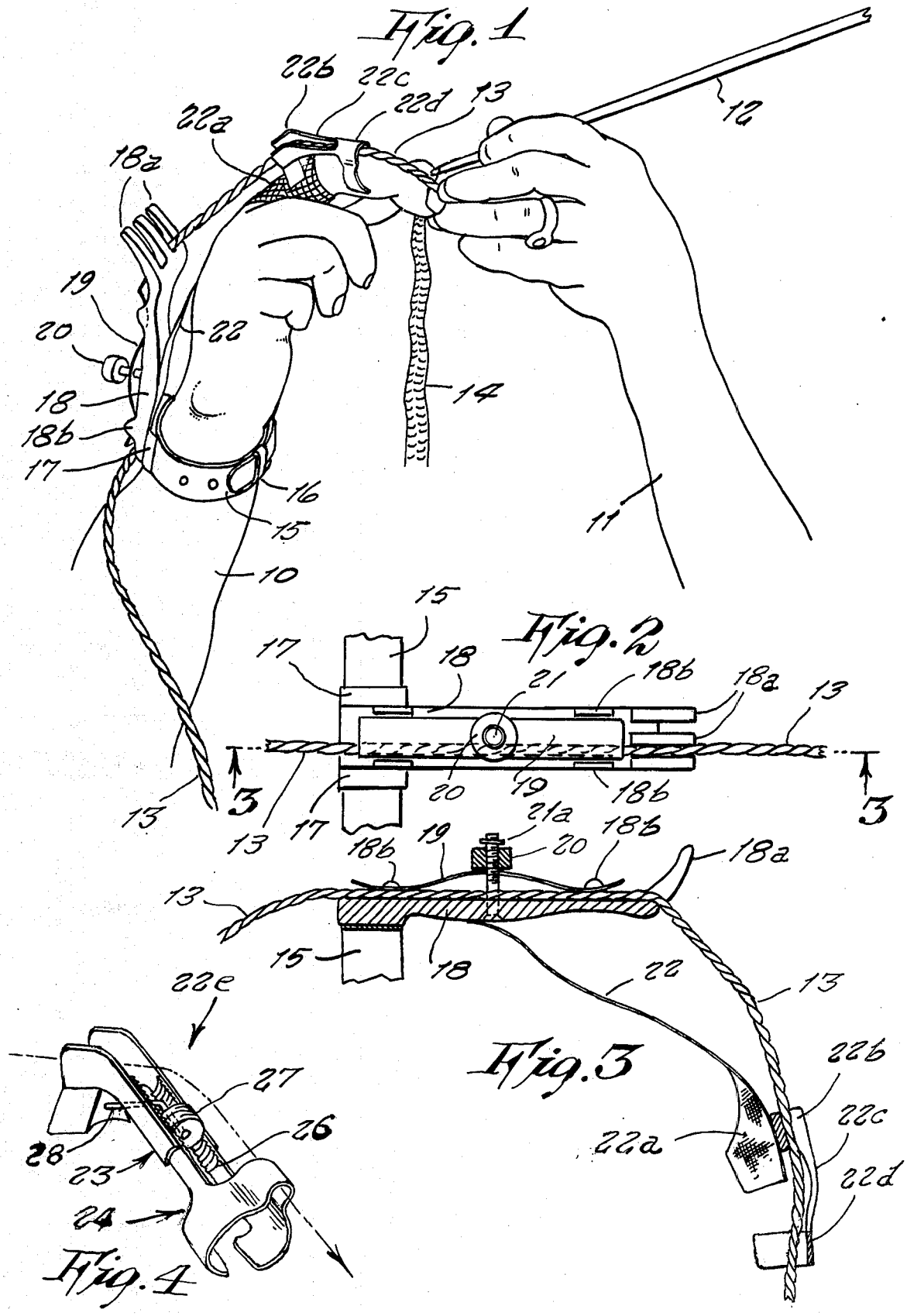
FIG. 1 is a perspective view of the invention shown in use by a person with a right disabled hand.
FIG. 2 is a top view thereof shown fragmentarily.
FIG. 3 is a cross sectional view on line 3—3 of FIG. 2.
FIG. 4 is a perspective view of a modified design of the yarn holder thereof and which is adjustable in length so as to selectively have it extend closer or further from the finger end, as wished by a person.

These and other objects are achieved by a device providing in combination a lateral guidance portion to prevent the yarn from deviating sideways; a feed resistance generating portion to retard the supply of fresh yarn to the crocheting needle held by the fit hand; and a retaining portion to retain the yarn on top of the forefinger of the disabled hand close to the crocheting needle.

These and other features may be derived from a specific embodiment of the invention given by way of examples illustrated in FIGS. 1–3.

DETAILED DESCRIPTION OF THE DRAWINGS

In FIG. 1, the viewer looks at a person in the process of knitting or crocheting. The disabled right hand is designated by 10, the still fit one 11. A thread of yarn 13 rises from a ball of yarn on the floor, passes through the device 18, **22*b*, 22*c* and emerges at 14 as woven fabric. A wrist band 15/16 carries a plastic bridge 17 to which is attached a forklike component 18 preferably made of light, but strong plastic material. FIGS. 2 and 3 give a top view 2—2 and a longitudinal cross section 3—3 respectively of that component. The forked end 18*a* includes spaced tines. There are also guide fins 18*b*. An undulated thin spring blade 19, made of phosphor bronze or hardened spring steel fits loosely between said fins 18*b*. A transverse bolt 21 anchored in component 18 passes at right angles through the middle of the blade and a threaded thumbwheel 20 bears against the blade. By turning the wheel 20 bears against the blade. By turning the wheel 20 the displacement of the blade (equals its pressure) can be adjusted. To prevent wheel 20 from falling off accidentally, the end of bolt 21 is thickened in some manner. In the illustrated embodiment a retaining clip 21*a* is provided which fits into a groove on bolt 21. (FIG. 3**).

As can best be seen from FIG. 3 there is also provided a strip of fabric 22 preferably made of nylon or the like, which at one end is molded between bridge 17 and component 18 and extends to the right ending in a cylindrical part **22*a*. Glued to this end is a yarn holder 22*b* substantially aligned with the longitudinal axis of 1B. The same has extension arms 22*c* ending in a half rounded plate 22*d*. The arms 22*c*** are elastically displacable.

Referring now to FIG. 4, a modified construction of yarn holder **22*a* is shown which is divided into two separate members 23 and 24 that are telescopically adjustable respective to each other in order that the plate 22*d* thereof can be selectively extended closer or further from the tip of the finger as individually wished by the person. This is accomplished by a screw thread 26 on the inner side of member 24 being engaged by a threaded nut 27 supported rotatably free on a shaft 28 secured to the member 23**.

Thus by brushing a hand or other finger across the exposed side of the nut, it can be rotated in either direction for making the adjustment easily. Accordingly, a knurl could be provided on the outer edge of the nut teeth so to frictionally allow it to rotate still more easily, such knurl being transversely to the thread.

The manner in which this part is attached to the hand 10 can be discerned in FIG. 1.

USE OF THE DEVICE

FIG. 1 is largely self-explanatory. The healthy hand 11 holds the crocheting needle and weaves the yarn into loops thereby drawing on more yarn to follow. A certain amount of resistance must be offered by the yarn to the crochet needle. This resistance is normally produced by the person holding the yarn thread between two fingers. According to the invention this is done by the spring blade 19; the same is dimensioned in such a manner that adjustment of wheel 20 produces an adequate range of frictional resistance between the yarn 13 and the flat portion of components 18.

The lateral guidance and tensoning of the yarn 13 is secured by the tines at forked end **18*a*. The best lateral position can be chosen by laying the yarn into one of the several guide grooves of 18*a*. Finally, part 22*d* holds the yarn on top of the forefinger. It follows any position of this finger because of the light bias pressure by the arms 22*c***.

It is noted that with this present crocheting aid invention, any handicapped person can learn to crochet from a printed instructions such as is provided in pamphlets.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

what is claimed is:

1. A crocheting aid for handicapped people comprising a wristband with a fork mounted thereon, said fork extending forward having spaced tines at a forward end, said fork having a rear end secured transversely to said band in combination with a fabric secured to said band and to an aligned yarn holder at a forward end provided with a finger hole below said holder, said yarn holder, fork and fabric being in longitudinal alignment when mounted in users hand with the band mounted about the users wrist and the users forefinger extending through said hole, said yarn holder including a guide for a strand of yarn and wherein said tines comprise guiding means for said yarn, which extends through the guide and tines, including adjustment means for varying the length of said yarn holder.

2. A crocheting aid as in claim 1, including means for varying the tension and frictional resistance to longitudinal movement of the yarn, the last said means being mounted on the fork between the rear end and the tines in longitudinal alignment with said fork, wherein said yarn extends between the last said means and the fork.

3. A crocheting aid as in claim 2, wherein the last means comprise a longitudinal spring plate mounted on the fork including a bolt secured at right angles to the plate and passing through a hole in said plate, further including a wheel threadedly mounted on said bolt over the plate for engagement therewith, whereby rotation of said wheel adjusts the pressure of the wheel on the plate to vary the frictional engagement of the yarn with the fork.

* * * * *